US007010258B2

(12) United States Patent
Wu et al.

(10) Patent No.: US 7,010,258 B2
(45) Date of Patent: Mar. 7, 2006

(54) HIGH HEAT TRANSFER FUSER ROLLER

(75) Inventors: Fangsheng Wu, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 45 days.

(21) Appl. No.: 10/814,316

(22) Filed: Mar. 31, 2004

(65) Prior Publication Data

US 2005/0220511 A1 Oct. 6, 2005

(51) Int. Cl.
*G03G 15/20* (2006.01)

(52) U.S. Cl. ..... 399/333

(58) Field of Classification Search ..... 399/333, 399/328

See application file for complete search history.

(56) References Cited

U.S. PATENT DOCUMENTS

| | | | | |
|---|---|---|---|---|
| 4,518,244 | A * | 5/1985 | Kageyama et al. | 492/53 |
| 4,984,027 | A | 1/1991 | Derimiggio et al. | 355/290 |
| 5,450,183 | A | 9/1995 | O'Leary | 355/285 |
| 5,960,245 | A | 9/1999 | Chen et al. | 399/333 |
| 6,020,038 | A | 2/2000 | Chen et al. | 428/36.9 |
| 6,190,771 | B1 | 2/2001 | Chen et al. | 428/375 |
| 6,225,409 | B1 | 5/2001 | Davis et al. | 525/104 |
| 6,429,249 | B1 | 8/2002 | Chen et al. | 524/432 |
| 6,490,430 | B1 | 12/2002 | Chen et al. | 399/333 |
| 6,512,913 | B1 * | 1/2003 | Hirst et al. | 399/328 |
| 6,567,641 | B1 | 5/2003 | Aslam et al. | 399/330 |
| 6,607,259 | B1 * | 8/2003 | Mott et al. | 347/18 |
| 6,678,495 | B1 * | 1/2004 | Badesha et al. | 399/320 |
| 2004/0165917 | A1 * | 8/2004 | Sugawara et al. | 399/333 |
| 2005/0141935 | A1 * | 6/2005 | Chen et al. | 399/333 |

FOREIGN PATENT DOCUMENTS

| | | | |
|---|---|---|---|
| JP | 10340023 | A * | 12/1998 |
| JP | 2002055557 | A * | 2/2002 |

* cited by examiner

*Primary Examiner*—Quana Grainger
(74) *Attorney, Agent, or Firm*—Carl F. Ruoff

(57) ABSTRACT

A high heat transfer efficiency fusing roller includes an annular elastomeric base cushion layer around a rigid cylindrical core member, with a high thermal conductivity layer around the base cushion layer, and a thin flexible release layer around the high thermal conductivity layer. The base cushion layer is less thermally conductive than the high thermal conductivity layer, which high thermal conductivity layer has a thermal conductivity equal to or greater than 1 Btu/hr/ft/F.

18 Claims, 2 Drawing Sheets

HIGH HEAT TRANSFER FUSER ROLLER

FIELD OF THE INVENTION

This invention relates to fusing stations in electrostatographic reproduction apparatus, and more particularly to an improved fusing roller with high heat transfer efficiency.

BACKGROUND OF THE INVENTION

In electrostatographic reproduction apparatus, an electrostatic latent image is formed on a primary image-forming member such as a photoconductive surface and is developed with thermoplastic toner particles to form a toner image. The toner image is thereafter transferred to a receiver member, e.g., a sheet of paper or plastic, and the toner image is subsequently fused or fixed to the receiver member in a fusing station using heat and pressure. The fusing station includes a fuser member which can be a roller, belt, or any surface having a suitable shape for fixing thermoplastic toner particles to the receiver member.

In fusing using a roller fuser member, the toned receiver member is commonly passed between a pair of engaged rollers that produce an area of pressure contact known as a fusing nip. In order to form the fusing nip, at least one of the rollers typically includes a compliant or conformable layer. Heat is transferred from at least one of the rollers to the toner in the fusing nip, causing the toner to partially melt and attach to the receiver member. In the case where the fuser member is a deformable heated roller, a resilient elastomeric layer is typically bonded to the core of the roller, with the roller having a smooth outer surface. Where the fuser member is in the form of a belt, e.g., a flexible endless belt that passes around the heated roller, the belt typically has a smooth outer surface which may also be hardened.

Simplex fusing stations attach toner to only one side of the receiver member at a time. In this type of fusing station, the engaged roller that contacts the unfused toner is commonly known as the fuser roller and is a heated roller. The roller that contacts the other side of the receiver member is known as the pressure roller and is usually unheated. Either or both rollers can have a compliant layer on or near the surface. It is common for one of these rollers to be driven rotatable by an external source while the other roller is rotated frictionally by the nip engagement.

A conventional toner fuser roller commonly includes a rigid cylindrical core member, typically a metallic core such as aluminum, coated with one or more synthetic layers usually formulated with polymeric materials made from elastomers. A resilient base cushion layer, which may contain filler particles to improve mechanical strength and/or thermal conductivity, is typically formed on the surface of the core, which may advantageously be coated with a primer to improve adhesion of the resilient layer. Roller base cushion layers are commonly made of silicone rubbers or silicone polymers such as, for example, polydimethylsiloxane (PDMS) polymers disclosed by the Chen, et al. patents (U.S. Pat. Nos. 5,960,245 or 6,020,038).

The most common type of fuser roller is internally heated, i.e., a source of heat is provided within the roller for fusing. Such a fuser roller generally has a hollow core, inside of which is located a source of heat, usually a lamp. Less common is an externally heated fuser roller, which fuser roller is typically heated by surface contact with one or more heating rollers. Externally heated fuser rollers are disclosed by the O'Leary patent (U.S. Pat. No. 5,450,183), the Derimiggio, et al. patent (U.S. Pat. No. 4,984,027), the Aslam, et al. patent (U.S. Pat. No. 6,567,641), and the Chen, et al. patent (U.S. Pat. No. 6,490,430).

Some roller fusers rely on film splitting of low viscosity oil to enable release of the toner and (hence) receiver member from the fuser roller. The oil is typically applied to the surface of the fuser from a donor roller coated with the oil provided from a supply sump. A donor roller is disclosed in the Chen, et al. patent (U.S. Pat. No. 6,190,771) and in the Chen, et al. patent application (U.S. patent application Ser. No. 09/960,661, filed Sep. 21, 2001).

Release oils (commonly referred to as fuser oils) are composed of, for example, polydimethylsiloxanes. When applied to the fuser roller surface to prevent the toner from adhering to the roller, fuser oils may, upon repeated use, interact with PDMS material included in the resilient layer(s) in the fuser roller, which in time can cause swelling, softening, and degradation of the roller. To prevent these deleterious effects caused by release oil, a thin barrier layer made of, for example, a cured fluoroelastomer and/or a silicone elastomer, is typically formed on the resilient cushion layer, as disclosed in the Davis, et al. patent (U.S. Pat. No. 6,225,409).

In the fusing of the toner image to the receiver member, the area of contact of a conformable fuser roller with the toner-bearing surface of a receiver member sheet as it passes through the fusing nip is determined by the amount of pressure exerted by the pressure roller and by the characteristics of the resilient cushion layer. The extent of the contact area helps establish the length of time that any given portion of the toner image will be in contact with and heated by the fuser roller.

Prior art internally heated fuser rollers typically have one or more synthetic polymeric layers including a deformable layer such as a base cushion layer surrounding a hollow metallic core member, with a source of heat such as a lamp provided within the hollow core member. Such fuser rollers rely on thermal conductivity through the synthetic layers for conduction of heat from the source of heat to the surface of the roller so as to provide heat for fusing toner particles to receiver members. The thermal conductivity, attainable by the use of one or more suitable particulate fillers, is determined by the filler concentration. The thermal conductivity of most polymers is very low and the thermal conductivity generally increases as the filler concentration is increased. However, if the filler concentration is too high, the mechanical properties of a polymer are usually compromised. For example, the stiffness of the synthetic layers may be increased by too much filler so that there is insufficient deformability to create a wide enough nip for proper fusing. Moreover, too much filler will cause the synthetic layers to have a propensity to delaminate or crack or otherwise cause failure of the roller.

Because the mechanical requirements of such an internally heated fuser roller require that the filler concentrations be moderate, the ability of the roller to transport heat is thereby limited. In fact, the concentration of filler in prior art internally heated deformable fuser rollers has reached a practical maximum. As a result, the number of copies that can be fused per minute is limited, and this in turn can be the limiting factor in determining the maximum throughput rate achievable in an electrostatographic printer. There is a need, therefore, to provide an improved fusing roller for increasing the number of prints that can be fused per minute, thereby providing opportunity for higher machine productivity.

An auxiliary internal source of heat may optionally be used with an externally heated fuser roller, e.g., as disclosed in the Stack, et al. patent (U.S. Pat. No. 6,567,641) and in the Chen, et al. patent (U.S. Pat. No. 6,490,430). Such an internal source of heat is known to be useful when the fusing station is quiescent and/or during startup when relatively cold toned receiver members first arrive at the fusing station for fusing therein. It will be evident from the preceding paragraph above that in order for such an auxiliary internal source of heat to be effective (when intermittently needed), the fuser roller must have a sufficiently large thermal conductivity. However, this requirement conflicts with a need to keep heat at the surface of an externally heated fuser roller, i.e., so as not to unnecessarily conduct heat into the interior which would compromise the fusing efficiency of the roller. Thus there remains a need to provide an improved efficiency fusing roller so that the throughput rate of an electrostatographic printer can be increased over that of prior art.

SUMMARY OF THE INVENTION

In light of the above, this invention is directed to a high heat transfer efficiency fusing roller for a fusing station of an electrostatographic printer for fusing toner images to receiver members. The high heat transfer efficiency fusing roller includes an annular elastomeric base cushion layer around a rigid cylindrical core member, with a high thermal conductivity layer around the base cushion layer, and a thin flexible release layer around the high thermal conductivity layer. The base cushion layer is less thermally conductive than the high thermal conductivity layer, which high thermal conductivity layer has a thermal conductivity equal to or greater than 1 BTU/hr/ft/° F. By comparison with a prior art fuser roller having a nominal fusing temperature and operated at a baseline throughput rate with a given heating load, the subject fuser roller at the same nominal fusing temperature has an improved fusing efficiency, the fusing station thereby having a higher throughput rate of fused receiver members for the same heating load. Alternatively, the improved efficiency permits the source of heat to use a smaller heating load when fusing at the same nominal fusing temperature and the same baseline throughput rate.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Fusing stations and fuser rollers for use therein according to this invention are readily includable in typical electrostatographic reproduction apparatus of many types, such as for example electrophotographic color printers.

The invention relates to an electrostatographic reproduction or printing apparatus for forming a toner image on a receiver member and utilizing a fusing station employing a deformable fuser roller for thermally fusing or fixing the toner image to a receiver member, e.g., of paper. The fusing station commonly includes two rollers which are engaged to form a fusing nip in which an elastically deformable fuser roller comes into direct contact with an unfused toner image as the receiver member is being frictionally moved through the nip. The fuser roller may be heated by an internal heat source, by an external heat source, or a combination of both. The toner image in an unfused state may include a single-color toner or it may include a composite image of at least two single-color toner images, e.g., a full color composite image made for example from superimposed black, cyan, magenta, and yellow single-color toner images. The unfused toner image has been transferred, e.g., electrostatically, to the receiver member from one or more toner image bearing members such as primary image-forming members or intermediate transfer members. It is well established that for high quality electrostatographic color imaging with dry toners, small toner particles are necessary.

The fusing station and fuser roller of the invention are suitable for the fusing of dry toner particles having a mean volume weighted diameter in a range of approximately between 2 mm–9 mm, and more typically, about 7 mm–9 mm, but the invention is not limited to these size ranges. The fusing temperature to fuse such particles included in a toner image on a receiver member is typically in a range 100° C.–200° C., and more usually, 140°–180° C., but the invention is not limited to these temperature ranges.

Figure 1:
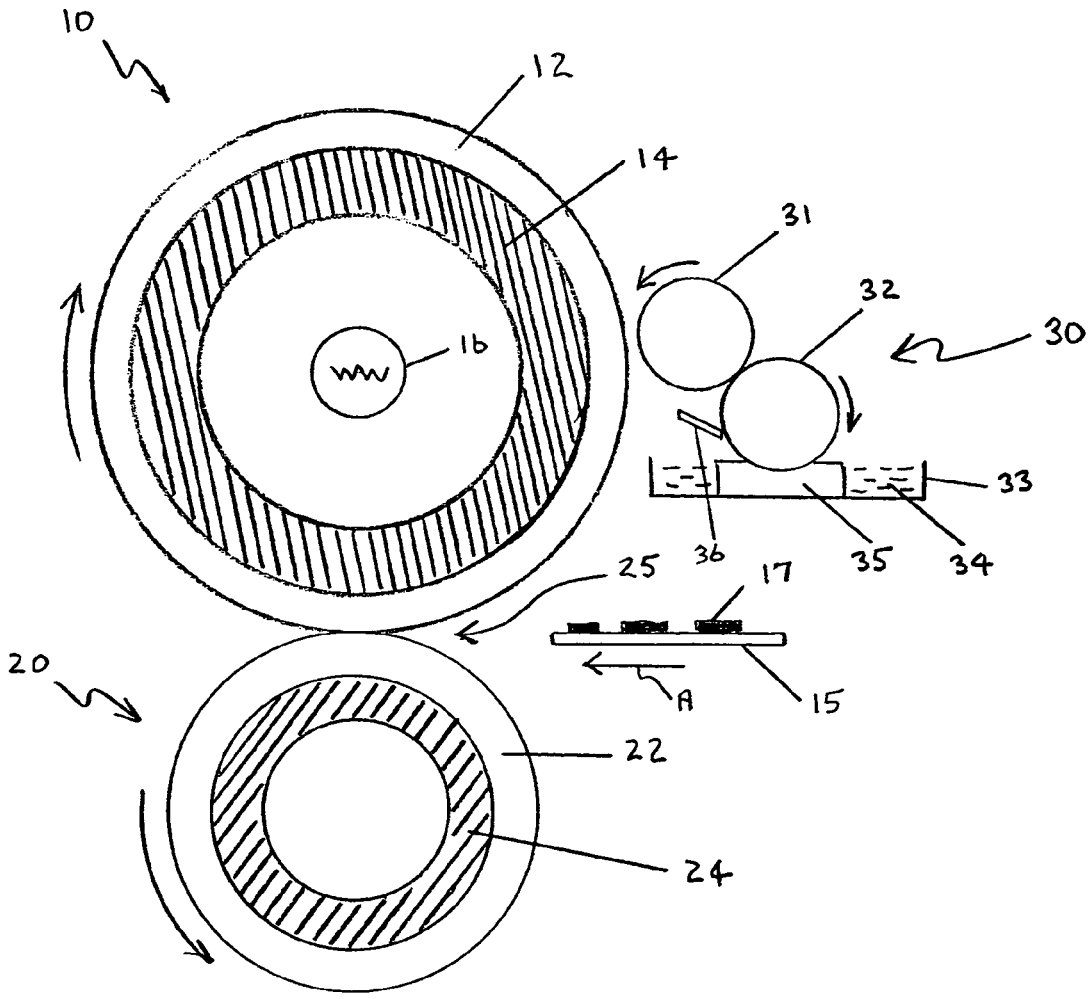
FIG. 1 shows a side elevational view of a fusing station with a fusing roller of the invention.

Turning now to the figures, FIG. 1 illustrates a simplex fusing station, of the type in which the fuser roller of the invention may be used. The fusing station includes a heated, elastically deformable fuser roller 10, engaged under pressure with a relatively harder, i.e., relatively nondeformable, pressure roller 20, so as to form a fusing nip 25. In this embodiment fuser roller 10 is heated by an internal heat source 16, for example a heat lamp, but in other embodiments fuser roller 10 could be externally heated, for example by contact with one or more heated rollers, or fuser roller 10 could be heated by a combination of internal and external heat sources. Fuser roller 10, described in detail below, is a multilayer roller incorporating a high thermal conductivity layer. A receiver member 15 carrying an unfused toner image 17 is shown moving in the direction of arrow A towards the fusing nip 25, by any suitable transport mechanism (not shown), for passage therethrough. Receiver member 15 is made of any suitable material, e.g., of paper or plastic, and the receiver member can be in cut sheet form (as depicted) or can be a continuous web.

Fuser roller 10 generally includes a rigid, cylindrical, core member 14, around which is a deformable annular structure 12 including at least one elastomeric layer. The core member 14 is preferably made of a thermally conductive material such as a metal, preferably aluminum, and the core member is typically hollow as shown. Preferably an outer diameter of the core member is in a range between about 5 inches and 7 inches, and the outer diameter is more preferably about 6.0 inches. The deformable annular structure 12 includes several layers and will be described in detail below.

Pressure roller 20 includes a rigid, cylindrical, core member 24 around which is an annular structure 22 including one or more layers. The core member 24 usually made of a metal, preferably aluminum, and typically (but not necessarily) hollow as shown. Preferably an outer diameter of the core member 24 is in a range between about 3 inches and 4 inches, and the outer diameter is more preferably about 3.5 inches. A preferred annular structure 22 includes a resilient base cushion layer and an outer layer around the base cushion layer (individual layers of structure 22 not separately shown). The base cushion layer of annular structure 22 preferably has a thickness in a range of approximately between 0.18 inches and 0.22 inches, and the thickness is more preferably about 0.20 inches.

The base cushion layer of structure 22 can for example be made of a commercially available condensation-crosslinked PDMS elastomer which contains about 32–37 volume percent aluminum oxide filler and about 2–6 volume percent iron oxide filler, sold by Emerson and Cuming (Lexington, Mass.) under the trade name EC 4952. Preferably the base cushion layer of structure 22 is coated on the core member 24 and the outer layer of structure 22 is formed as a topcoat layer on the underlying base cushion layer, with the topcoat layer preferably made of a fluorocarbon thermoplastic random copolymer (FLC) material such as for example the copolymer of vinylidene fluoride, tetrafluoroethylene and hexafluoropropylene disclosed in the Chen, et al. patent (U.S. Pat. No. 6,429,249). The topcoat layer thickness is preferably in a range of approximately between 0.001 inches–0.004 inches, and more preferably 0.0015 inches–0.0025 inches.

A suitable pressure roller 20 is preferably similar to the pressure roller disclosed in the Chen, et al. patent (U.S. Pat. No. 6,429,249). Due to the incorporated fillers, the EC 4952 material usable for the base cushion layer of structure 22 has a relatively high nominal thermal conductivity of about 0.35 BTU/hr/ft/° F. However, the thermal conductivity of the base cushion layer of structure 22 is not critical to the operation of the fusing station. In certain circumstances, a considerably lower thermal conductivity of the base cushion layer of structure 22 may be preferable so as not to drain too much heat from the contact zone of nip 25. A preferred base cushion layer of pressure roller 20 is made of an elastomeric material having any suitable thermal conductivity, which elastomeric material has a Shore A hardness greater than about 50, preferably greater than about 60. The base cushion layer may include a particulate filler.

Operating in conjunction with fusing roller 10 is an oiling roller mechanism, generally indicated by numeral 30, including a wick 35 in contact with a liquid release agent (e.g., fuser oil) 34 contained in reservoir 33. Wick 35 absorbs the release agent 34 and transfers the release agent to a metering roller 32, with the amount of release agent on the surface of metering roller 32 controlled by blade 36. Metering roller 32 is in contact with a release agent donor roller 31, which release agent donor roller contacts fuser roller 10 and thereby delivers a continuous flow of release agent 34 to the surface of fuser roller 10. A preferred release agent donor roller is similar to that of the cited Chen, et al. patent application (U.S. patent application Ser. No. 09/960,661, filed Sep. 21, 2001).

Approximately 1 to 20 milligrams of release agent is needed for each receiver member (e.g., receiver member sheet 15) passing through nip 25. As is well known, a suitable release agent is typically a silicone oil. A preferred polymeric release agent 34 for use in the fusing station is an amine-functionalized polydimethylsiloxane having a preferred viscosity of about 300 centipoise as disclosed in the Chen, et al. patent (U.S. Pat. No. 6,190,771).

A suitable release agent donor roller 31 for use in the fusing station includes for example a hollow aluminum core of outer diameter about 0.875 inches, the core coated by a cushion layer about 0.230 inches thick made of a compliant material having a low thermal conductivity such as for example obtainable commercially as S5100 from Emerson and Cuming (Lexington, Mass.), with a release layer about 0.0025 inches thick coated on the cushion layer (individual layers not illustrated in FIG. 1). The release layer can be made from an interpenetrating network composed of a crosslinked fluoroelastomer and two different silicone elastomers such as disclosed in the Davis, et al. patent (U.S. Pat. No. 6,225,409). More preferably, the release layer is made of a copolymer of vinylidene fluoride, tetrafluoroethylene and hexafluoropropylene as disclosed in the Chen, et al. patent (U.S. Pat. No. 6,429,249). Any suitable dimensions of the core, cushion layer, and release layer may be used.

In lieu of the oiling roller mechanism 30, an oiling web mechanism (not illustrated) may be used, the oiling web mechanism including a movable fuser-oil-impregnated donor web pressed against fuser roller 10 by using one or more backup rollers.

A selectively activated source of heat is located substantially within the interior hollow core member 14. The internal source of heat is preferably a tubular heating lamp 16 coaxially located along the central longitudinal axis of core member 14. Intermittent or variable ohmic heating (as may be required) of lamp 16 is selectively controllable by a programmable power supply (not shown).

As receiver member 15 traverses nip 25, the amount of heat transferred from fuser roller 10 to receiver member 15 and toner image 17 is dependent on the width of nip 25 and the thermal conductivity of annular structure 12. The wider the nip 25 and the higher the thermal conductivity of annular structure 12, the greater the amount of heat transferred to receiver member 15 and toner image 17. For a given nip pressure, the more compliant annular structure 12, the wider the nip 25. Heat transfer to receiver member 15 and toner image 17 is therefore maximized when both the compliance and thermal conductivity of annular structure 12 are maximized. Unfortunately compliance and thermal conductivity are contradistinctive.

Elastomeric materials suitable for use as compliant layers in fuser rollers have inherently low thermal conductivity. The thermal conductivity of these elastomeric materials may be increased by incorporating particulate fillers, such as for example metals, metal oxides, metal hydroxides, metal salts, and mixtures thereof into these elastomeric materials. The thermal conductivity, attainable by the use of one or more suitable particulate fillers, is determined by the filler concentration. The thermal conductivity generally increases as the filler concentration is increased. However, the compliance of these elastomeric materials generally decreases as the filler concentration is increased. It has been discovered that a novel combination of annular layer materials for annular structure 12 may be provided, with such combination resulting in higher heat transfer rates than prior art fusing rollers.

Figure 2:
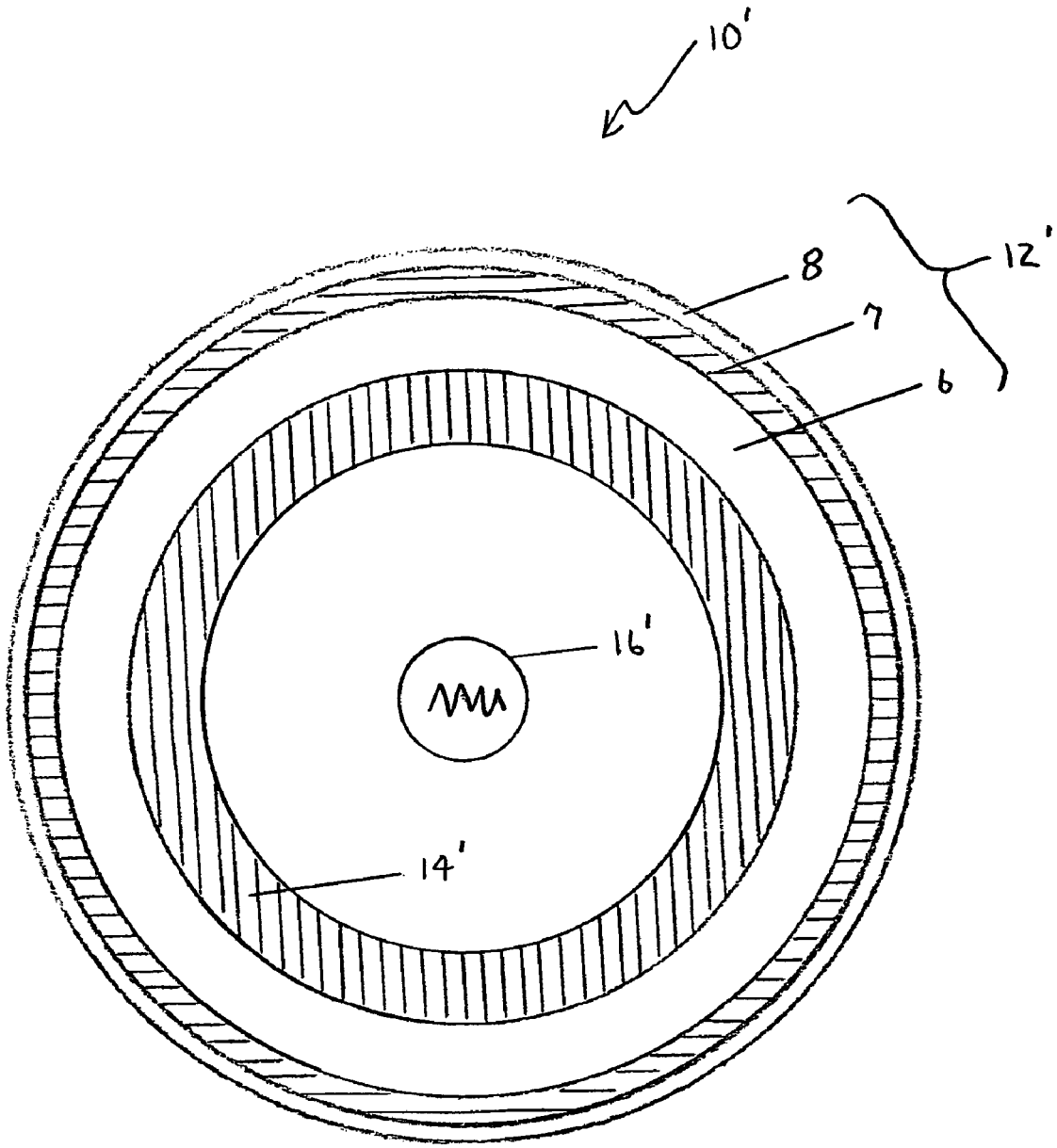
FIG. 2 shows, in an axially directed view, on an enlarged scale, the layers of the fuser roller of the invention.

FIG. 2 shows an axial view cross section of a preferred embodiment of the fuser roller of the invention, designated generally be the numeral 10', for use in an electrostatographic reproduction apparatus fusing station. Elements having a prime (') in FIG. 2 refer to the corresponding unprimed elements in FIG. 1. The activated source of heat is a lamp 16' which is entirely similar to the lamp 16 described above, and the core member 14' is preferably thermally conductive and otherwise entirely similar to core member 14. In the preferred embodiment 10', the elastically deformable annular structure 12' is a trilayer structure including a base cushion layer 6 around the core member 14', a high thermal conductivity layer 7 around the base cushion layer 6, and a flexible release layer 8 around the high thermal conductivity layer 7.

The base cushion layer (BCL) 6 is preferably formed on the core member 14' by any suitable coating method, with BCL 6 having a thermal conductivity preferably in a range of approximately between 0.1 BTU/hr/ft/° F. to 0.2 BTU/ hr/ft/° F., and more preferably between 0.15 BTU/hr/ft/° F. to 0.17 BTU/hr/ft/° F. Base cushion layer 6 may be made of any suitable resilient elastomeric material, such as for example a highly crosslinked polyorganosiloxane and may include a particulate filler. The filler is preferably primarily a structural filler for strengthening the base cushion layer, and the filler may further include a minority proportion of thermally conductive particles, such as for example particles of ferric oxide. The structural filler particles are made of materials such as mineral silica particles, fumed silica, and the like. The total weight percentage of filler in BCL 6 is preferably less than about 30% w/w, and more preferably is in a range of approximately between 10% w/w to 20% w/w. A filler in BCL 6 preferably has a particle size in a range of approximately between 0.1 μm to 20 μm, and more preferably 0.5 μm to 10 μm. BCL 6 may have any suitable thickness. Preferably, the thickness of BCL 6 is in a range of approximately between 0.180 inches to 0.250 inches, and more preferably, 0.190 inches to 0.195 inches.

The high thermal conductivity layer (HTCL) 7 has a thermal conductivity preferably equal to or greater than 1 BTU/hr/ft/° F. In the preferred embodiment HTCL 7 is a metal with a thermal conductivity greater than 5 BTU/hr/ft/° F. Such a metal may be copper, brass, aluminum, or nickel. In one embodiment HTCL 7 is a removable replaceable annular sleeve member comprised of electroformed nickel available from Stork Screens America, Inc., of Charlotte, N.C. HTCL 7 may also be fabricated from a metal sheet by, for example, forming a smooth seam by ultrasonic welding or by using an adhesive.

The flexible release layer 8 is preferably formed on the HTCL 7 by any suitable coating method including ring coating and blade coating. Flexible release layer (FRL) 8 is preferably made with a chemically unreactive, low surface energy, flexible, polymeric material suitable for high temperature use, such as for example a fluoropolymer. A preferred polymeric material for inclusion in FRL 8 is a fluorocarbon thermoplastic random copolymer (FLC) material such as for example the copolymer of vinylidene fluoride, tetrafluoroethylene and hexafluoropropylene as disclosed in the Chen, et al. patent (U.S. Pat. No. 6,429,249), the FLC random copolymer having subunits of:

$$-(CH_2CF_2)x-,\ -(CF_2CF(CF_3))y-,\ \text{and}\ -(CF_2CF_2)z-,$$

wherein, x is from 1 to 50 or 60 to 80 mole percent, y is from 10 to 90 mole percent, z is from 10 to 90 mole percent, x+y+z equals 100 mole percent.

The FRL 8 may have any suitable thickness and may include one or more particulate fillers. It is preferred that the one or more particulate fillers in of FRL 8 include zinc oxide particles or fluoroethylenepropylene (FEP) resin particles. However, in substitution of or in addition to the aforementioned one or more particulate fillers, any other particulate filler material may be included in FRL 8, either singly or in combination. It is necessary for good release of a toner image to keep the filler concentration relatively low and the particle size of the filler small, so that a matte effect on the toner image due to filler particles at the surface of FRL 8 can be minimized.

A filler used in the formulation of FRL 8 preferably has a particle size in a range of approximately between 0.1 μm to 10 μm, and more preferably 0.1 μm to 2.0 μm. The total concentration of fillers included in FRL 8 is preferably less than about 20% by weight. Specifically, in a preferred formulation of FRL 8 which includes zinc oxide and FEP particles, the concentration of zinc oxide is in a range of approximately between 5% to 7% w/w, and the concentration of FEP particles is in a range of approximately between 7% to 9% w/w. Preferably, the thickness of the FRL 8 is in a range of approximately between 0.001 inches to 0.004 inches, and more preferably 0.0015 inches to 0.0025 inches. The thermal conductivity of FRL 8 is preferably no less than approximately 0.07 BTU/hr/ft/° F., and more preferably in a range of approximately between 0.08 BTU/hr/ft/° F. to 0.11 BTU/hr/ft/° F.

The outer surface of the FRL 8 is preferably very smooth and the smoothness can be measured by any known method. Typically the smoothness of FRL 8 can be characterized by a gloss measurement using for example a gloss meter, such as a Micro-TRI-Gloss 20-60-85 Glossmeter available from BYK Gardener USA of Rivers Park, Md. A Gardener gloss value is proportional to the intensity of specularly reflected light reflected off a surface divided by the intensity of the incident light for a specified angle of incidence measured from a perpendicular to the surface (angle of incidence equal to the angle of reflection), e.g., at 20, 60, or 85 degrees. Thus, a G60 gloss value is measured at an angle of 60 degrees. A suitable G60 gloss value for the FRL 8 is preferably greater than approximately 10, and more preferably, greater than or equal to approximately 12.

In summary, in improving over prior art, the subject fuser roller having a high thermal conductivity layer around a relatively thermally insulating base cushion layer gives a greatly improved heat transfer advantage for fusing toner images to receiver members in a fusing station of the invention. This improved heat transfer advantage can be utilized to provide a high productivity (throughput rate) of the fusing station for a given nominal fusing temperature as required by a given type of toner particles and type of receiver member. Alternatively, the improved heat transfer advantage permits the process speed to be reduced, thereby allowing a reduced external heating load from the external source of heat.

The invention has been described in detail with particular reference to certain preferred embodiments thereof, but it will be understood that variations and modifications can be effected within the spirit and scope of the invention.

What is claimed is:

1. In a fusing station for fusing a toner image to a receiver member, said fusing station including a heated fuser roller operatively associated with a pressure roller, said fuser roller comprising:

a rigid, cylindrical, thermally conductive, metal core member;

a multilayer deformable annular structure around said core member, said deformable annular structure including an elastomeric base cushion layer innermost around said core member, a high thermal conductivity layer around said base cushion layer, said high thermal conductivity layer comprising a metal having thickness in a range of approximately between 0.002 inches to 0.005 inches, and a thin flexible toner release layer around said high thermal conductivity layer;

wherein thermal conductivity of said base cushion layer is lower than thermal conductivity of said high thermal conductivity layer; and wherein the value of thermal conductivity of said high thermal conductivity layer is equal to or greater than 5 BTU/hr/ft/° F.

2. The fuser roller of claim 1, wherein:

said thermal conductivity of said base cushion layer is in a range of approximately between 0.1 BTU/hr/ft/° F. to 0.2 BTU/hr/ft/° F.; and said thickness of said base cushion layer is in a range of approximately between 0.180 inches to 0.250 inches.

3. The fuser roller of claim 2, wherein:

said thermal conductivity of said base cushion layer is in a range of approximately between 0.15 BTU/hr/ft/° F. to 0.17 BTU/hr/ft/° F.; and said thickness of said base cushion layer is in a range of approximately between 0.190 inches to 0.195 inches.

4. The fuser roller of claim 1, wherein said base cushion layer is an elastomeric material comprising less than 30% by weight of a particulate filler including a structural filler, said particulate filler including particles having sizes in a range of approximately between 0.1 μm to 20 μm, said particles including at least one particulate filler selected from the group consisting of: mineral silica particles, fumed silica particles, and iron oxide particles.

5. The fuser roller of claim 1, wherein:

said high thermal conductivity layer includes a metal with thermal conductivity equal to or greater than 5 BTU/hr/ft/° F. and thickness in a range of approximately between 0.002 inches to 0.005 inches.

6. The fuser roller of claim 1, wherein:

said metal is selected from the group consisting of: copper, brass, aluminum, and nickel.

7. The fuser roller of claim 1, wherein said thickness of said toner release layer is equal to or less than 0.0005 inches.

8. The fuser roller of claim 1, wherein said toner release layer includes a fluoropolymer.

9. The fuser roller of claim 8, wherein said fluoropolymer includes a random copolymer of vinylidene fluoride, tetrafluoroethylene, and hexafluoropropylene, said random copolymer having subunits of:

—(CH2CF2)x-, —(CF2CF(CF3))y-, and —(CF2CF2)z-, wherein:

x is from 1 to 50 or 60 to 80 mole percent of vinylidene fluoride, y is from 10 to 90 mole percent of hexafluoropropylene, z is from 10 to 90 mole percent of tetrafluoroethylene, and x+y+z equals 100 mole percent.

10. The fuser roller of claim 1, wherein said toner release layer includes a particulate filler.

11. The fuser roller of claim 10, wherein in said toner release layer, said particulate filler has a particle size in a range of approximately between 0.1 μm to 10 μm; and said particulate filler has a total concentration in said toner release layer of less than about 20% by weight.

12. The fuser roller of claim 11, wherein said particulate filler has a particle size in a range of approximately between 0.1 μm to 2.0 μm.

13. The fuser roller of claim 10, wherein:

said particulate filler in said toner release layer includes zinc oxide particles and fluoroethylenepropylene resin particles, said zinc oxide particles having a concentration in a range of approximately between 5% to 7% by weight, and said fluoroethylenepropylene resin particles having a concentration in a range of approximately between 7% to 9% by weight.

14. The fuser roller of claim 1, wherein said fuser roller further comprises a removable replaceable annular sleeve member, said sleeve member including at least one of the layers included in said deformable annular structure.

15. The fuser roller of claim 1, wherein:

said base cushion layer includes an addition-crosslinked polydimethylsiloxane; and said toner release layer includes a fluorocarbon thermoplastic random copolymer of vinylidene fluoride, tetrafluoroethylene and hexafluoropropylene.

16. The fuser roller of claim 1, wherein said flexible release layer includes a chemically unreactive, low surface energy, flexible, polymeric material suitable for high temperature use.

17. In an electrostatographic reproduction apparatus for forming a toner image on a receiver member, a fusing station for fusing said toner image to said receiver member, said fusing station comprising:

a pressure roller;

a fuser roller operatively associated with a pressure roller, said fuser roller being elastically deformable and engaged under pressure with said pressure roller so as to form a fusing nip there between, said pressure roller being relatively harder than said fuser roller, said toner image on said receiver member being moved through said fusing nip for said fusing;

wherein said fuser roller includes a rigid, cylindrical, thermally conductive core member; a multilayer deformable annular structure around said core member, said deformable annular structure including an elastomeric base cushion layer innermost around said core member, an high thermal conductivity layer around said base cushion layer, said high thermal conductivity layer comprising a metal having thickness in a range of approximately between 0.002 inches to 0.005 inches, and a thin flexible toner release layer around said high thermal conductivity layer;

wherein thermal conductivity of said base cushion layer is lower than thermal conductivity of said high thermal conductivity layer; and wherein the value of thermal conductivity of said high thermal conductivity layer is equal to or greater than 5 BTU/hr/ft/° F.

18. The fusing station of claim 17, wherein further:

said thermal conductivity of said base cushion layer is in a range of approximately between 0.1 BTU/hr/ft/° F. to 0.2 BTU/hr/ft/° F.;

said thickness of said base cushion layer is in a range of approximately between 0.180 inches to 0.250 inches; and said thickness of said toner release layer is equal to or less than 0.0005 inches.

* * * * *